US005475896A

United States Patent [19]

Wang

[11] Patent Number: 5,475,896

[45] Date of Patent: Dec. 19, 1995

[54] FURNITURE HANDLE

[75] Inventor: Shen-Huang Wang, Taiwan, Taiwan

[73] Assignee: Hua Peng Limited Co., Taiwan

[21] Appl. No.: 287,805

[22] Filed: Aug. 9, 1994

[51] Int. Cl.[6] ..... A47B 95/02

[52] U.S. Cl. ..... 16/111 R

[58] Field of Search ..... 16/111 R, 114 R, 16/116 R, 124, 110 A, 110 R, DIG. 12, DIG. 41, DIG. 24, DIG. 25

[56] References Cited

U.S. PATENT DOCUMENTS

| | | | |
|---|---|---|---|
| 3,500,973 | 3/1970 | Bush | 16/111 R |
| 3,692,155 | 9/1972 | Laurita | 16/116 R |
| 5,321,868 | 6/1994 | Coulson et al. | 16/111 R |

*Primary Examiner*—P. Austin Bradley

*Assistant Examiner*—Chuck Y. Mah

*Attorney, Agent, or Firm*—Beveridge, DeGrandi, Weilacher & Young

[57] ABSTRACT

A furniture handle including a handle frame having a coupling portion in the middle, and a hand grip mounted around the coupling portion, wherein the hand grip has a longitudinal through hole, a V-shaped opening extended from the longitudinal through hole to the outside along the length of the hand grip and defining two rectangular stop flanges; the handle frame has two wedge blocks perpendicularly extended from the coupling portion and inserted through thee V-shaped opening into the longitudinal through hole, two pairs of retaining portions raised from the wedge blocks and respectively engaged with the stop flanges to stop the respective wedge block from being moved backwards permitting the flat coupling portion to be firmly retained inside the V-shaped opening.

1 Claim, 3 Drawing Sheets

FURNITURE HANDLE

BACKGROUND OF THE INVENTION

The present invention relates to furniture handles, and relates more particularly to such a furniture handle which is comprised of a handle frame and a hand grip that can be conveniently fastened together without the use of any bonding agent or external fastening devices.

FIG. 1 shows a furniture handle according to the prior art which comprises a handle frame A integrally molded through a die casting process and having a handle shaft A1 with a flat coupling portion A2, and a hand grip B having a mounting hole B1 longitudinally disposed at one side. During the assembly process, the surface of the mounting hole B1 of the hand grip B is covered with a layer of bonding resin, then the flat coupling portion A2 is inserted into the mounting hole B1 comprising a handle shaft 11 defining a flat coupling portion 12 in the middle for mounting the hand grip 2, and then the bonding resin is heat dried and then cooled down. After cooling, the handle frame A and the hand grip B are fastened together. This assembly process is complicated. During the assembly process, the bonding resin may flow out of the hand grip to contaminate the handle frame or the operator's hands. During the application of the bonding resin, the bonding resin releases a strong smell causing the operator to feel uncomfortable. Furthermore, the bonding resin tends to disintegrate under a cold weather, causing the hand grip to disconnect from the handle frame.

SUMMARY OF THE INVENTION

The present invention has been accomplished to provide a furniture handle which eliminates the aforesaid drawbacks. It is therefore an object of the present invention to provide a furniture handle which eliminates the use of any bonding resin. It is another object of the present invention to provide a furniture handle which is easy to assemble. It is still another object of the present invention to provide a furniture handle which is durable in use and free from the affect of weather. To achieve the aforesaid objects, there is provided a furniture handle comprised of a handle frame having a coupling portion in the middle, and a hand grip mounted around the coupling portion. The hand grip has a longitudinal through hole, a V-shaped opening extended from the longitudinal through hole to the outside along the length of the hand grip and defining two rectangular stop flanges. The handle frame has two wedge blocks perpendicularly extended from the coupling portion and inserted through thee V-shaped opening into the longitudinal through hole, two pairs of retaining portions raised from the wedge blocks and respectively engaged with the stop flanges to stop the respective wedge block from being moved backwards permitting the flat coupling portion to be firmly retained inside the V-shaped opening.

DETAILED DESCRIPTION OF THE PREFERRED EMBODIMENT

Figure 1:
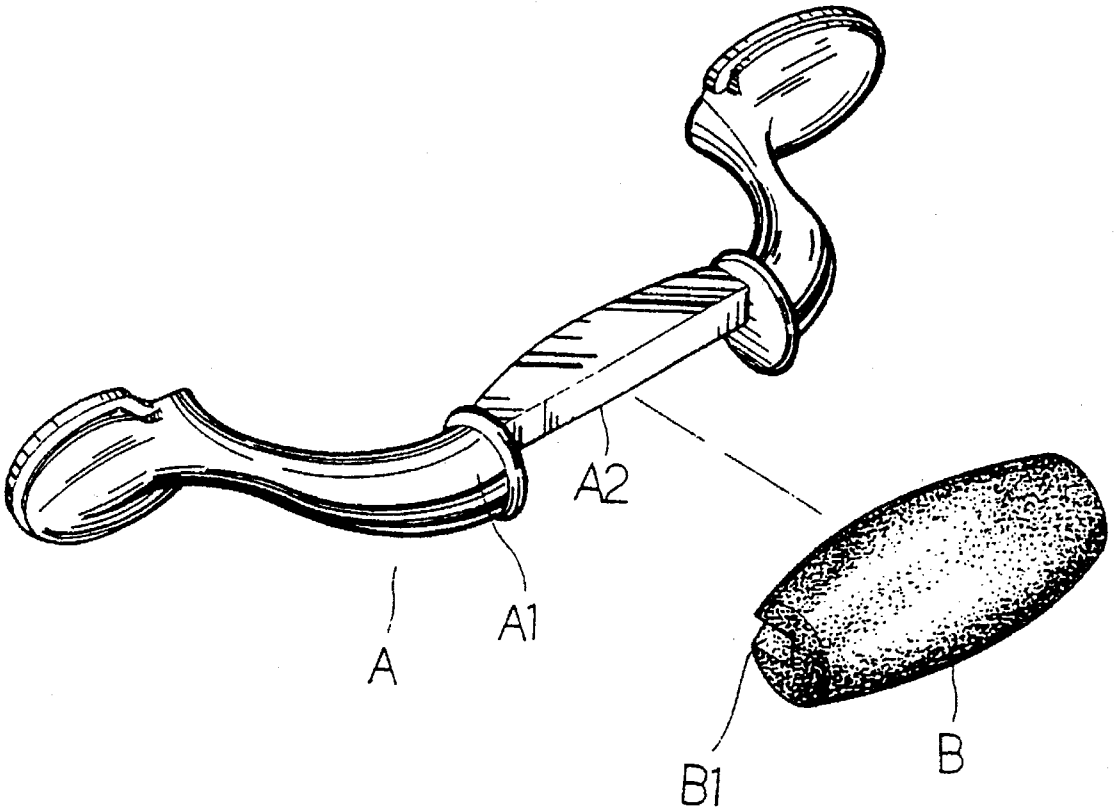
FIG. 1 PRIOR ART
FIG. 1 is an exploded view of a furniture handle according to the prior art.
Figure 2:
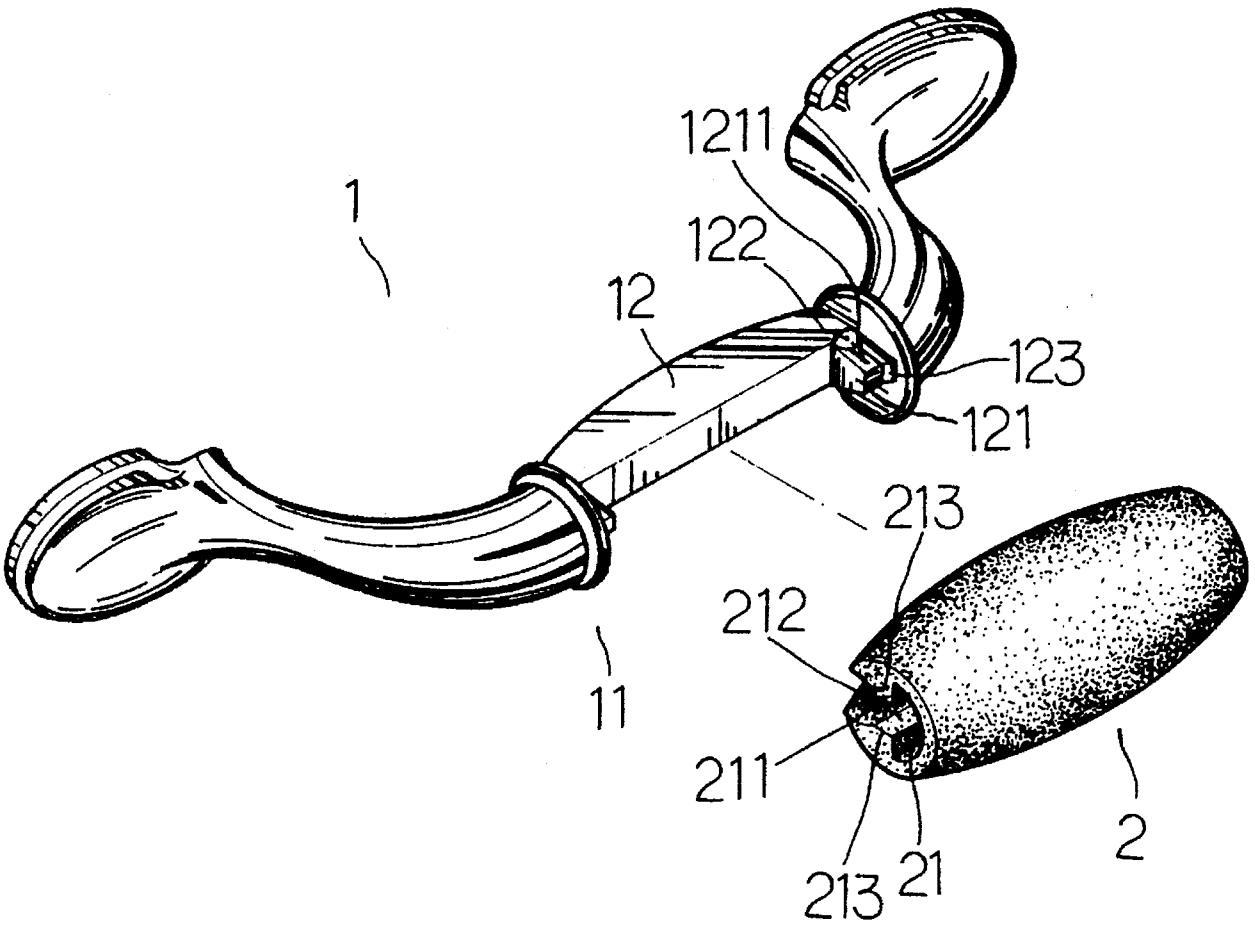
FIG. 2 is an exploded view of a furniture handle according to the present invention.
Figure 3:
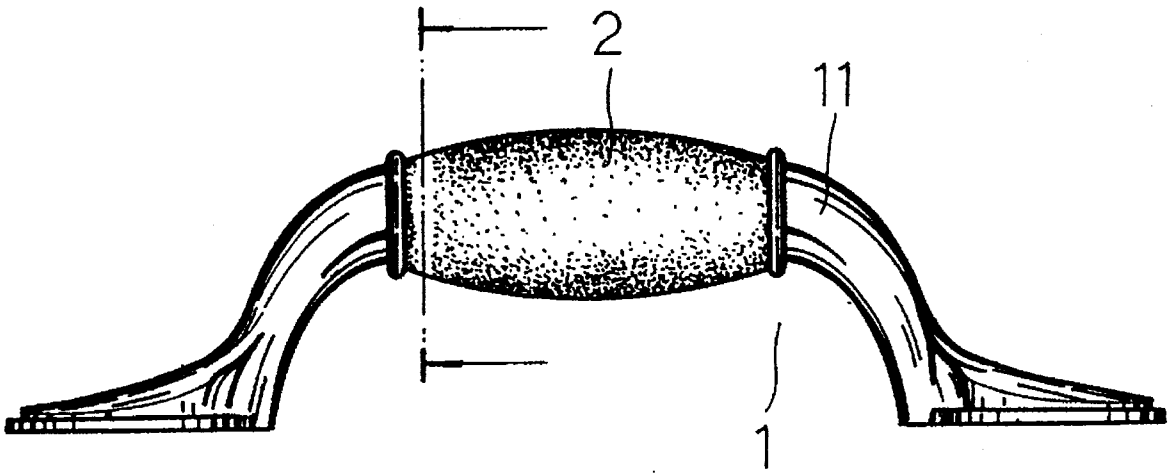
FIG. 3 is an assembly view of the furniture handle of FIG. 2.

Referring to FIGS. 2 and 3, a furniture handle in accordance with the present invention is generally comprised of a handle frame 1 and a hand grip 2 mounted around the handle frame 1. The handle frame 1 is integrally molded through a die casting process, comprising a handle shaft 11 defining a flat coupling portion 12 in the middle for mounting the hand grip 2, and two symmetrical wedge blocks 121 respectively perpendicularly extended from two opposite ends of the coupling portion 12. Each wedge block 121 comprises two opposite sloping sides 1211, two retaining portions 122 respectively raised from the sloping sides 1211 at the bottom, and a sloping projection 123 raised from the top. The sloping sides 1211 slope outwards downward. Therefore, the thickness of each wedge block 121 reduces gradually toward the top. The hand grip 2 comprises a longitudinal through hole 21, a substantially V-shaped opening 211 extended from the longitudinal through hole 21 to the periphery along the length and made gradually bigger in width toward the outside, two rectangular stop flanges 213 bilaterally disposed at the entrance 212 between the V-shaped opening 211 and the longitudinal through hole 21.

Figure 4:
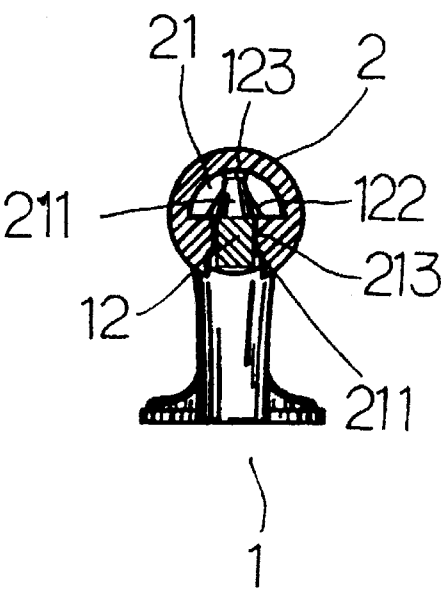
FIG. 4 is a sectional view taken on FIG. 3.

Referring to FIG. 4 and FIG. 3 again, by means of the sloping sides 1211, the wedge blocks 121 can be conveniently inserted through the V-shaped opening 211 into the longitudinal through hole 21. When the wedge blocks 121 are respectively perpendicularly inserted into the longitudinal through hole 21, the retaining portions 122 become engaged with the rectangular flanges 213 to prohibit the wedge blocks 121 from being pulled backwards, and therefore the hand grip 2 is firmly retained to the handle shaft 11 of the handle frame 1. When assembled, the flat coupling portion 12 of the handle shaft 11 is received within the v-shaped opening 211, and the sloping projection 123 stops against the peripheral wall of the longitudinal through hole 21. Because the sloping projection 123 and the retaining portions 122 on each wedge block 121 are stopped against the inside wall of the hand grip 2 at the three angles of a triangle, the connection between the handle frame 1 and the hand grip 2 is secured.

What is claimed is:

1. A furniture handle comprising a handle frame having a flat coupling portion in the middle, and a hand grip mounted around said coupling portion, wherein said hand grip comprises a longitudinal through hole, a substantially V-shaped opening extended from said longitudinal through hole to the outside along the length of said hand grip and made gradually bigger in width toward the outside, which receives said flat coupling portion, two rectangular stop flanges bilaterally disposed between said V-shaped opening and said longitudinal through hole; said handle frame comprises two wedge blocks perpendicularly extended from said coupling portion at two opposite ends and respectively inserted through said V-shaped opening into said longitudinal through hole, each wedge block having two retaining portions respectively engaged with said stop flanges to stop the respective wedge block from being moved backwards from said longitudinal through hole toward said V-shaped opening and a top projection against an inside wall of said hand grip.

* * * * *